US012503286B2

(12) United States Patent
Brandt Sanz

(10) Patent No.: US 12,503,286 B2
(45) Date of Patent: Dec. 23, 2025

(54) APPARATUS AND PROCESS FOR MAKING A WATER SOLUBLE POUCH

(71) Applicant: The Procter & Gamble Company, Cincinnati, OH (US)

(72) Inventor: Miguel Brandt Sanz, Etterbeek (BE)

(73) Assignee: The Procter & Gamble Company, Cincinnati, OH (US)

( * ) Notice: Subject to any disclaimer, the term of this patent is extended or adjusted under 35 U.S.C. 154(b) by 125 days.

(21) Appl. No.: 18/137,550

(22) Filed: Apr. 21, 2023

(65) Prior Publication Data

US 2023/0339663 A1 Oct. 26, 2023

(30) Foreign Application Priority Data

Apr. 21, 2022 (EP) ..... 22169199

(51) Int. Cl.
*B65D 65/46* (2006.01)

(52) U.S. Cl.
CPC ..... *B65D 65/46* (2013.01)

(58) Field of Classification Search
CPC ... C11D 17/042; C11D 17/045; C11D 3/3947; B65D 65/46; B65D 65/466; B65D 85/808
See application file for complete search history.

(56) References Cited

U.S. PATENT DOCUMENTS

2015/0336691 A1* 11/2015 Fowler ..... B65D 65/46 53/553
2017/0368580 A1* 12/2017 Brandt Sanz ..... B65B 47/02

FOREIGN PATENT DOCUMENTS

JP 3805605 B2 5/2006
WO WO-2017222983 A1 * 12/2017 ..... B08B 5/02

OTHER PUBLICATIONS

Machine translation of JP3805605 B2; Inventor: Seiichiro; Publication date: Aug. 2, 2006.*
16263F Extended European search report and search opinion for Application No. 22169199.1, dated Sep. 15, 2022, 10 pages.

* cited by examiner

*Primary Examiner* — Vishal I Patel
(74) *Attorney, Agent, or Firm* — Abigail O. Idokogi; George H. Leal; Gary J. Foose

(57) ABSTRACT

An apparatus including a thermoforming mold having a forming surface; a plurality of spaced apart recesses in the forming surface, wherein each recess includes a vacuum orifice and each vacuum orifice is in fluid communication with a vacuum source; a continuous land area (250) surrounding the recesses, wherein portions of the land area between the recesses have an average roughness Ra from 2.2 μm to 10 μm.

12 Claims, 9 Drawing Sheets

A

B

APPARATUS AND PROCESS FOR MAKING A WATER SOLUBLE POUCH

FIELD OF THE INVENTION

Process for making water soluble pouches containing a substrate treatment composition.

BACKGROUND OF THE INVENTION

Water soluble pouches for delivering substrate treatment compositions, such as dishwashing detergents, laundry detergents, surface cleaning compositions, and laundry treatment compositions, are increasing in popularity globally. Typically, the consumer places the pouch in a compartment in the dishwashing machine or in the drum of a clothing washing machine or bucket of water, the pouch is exposed to water, and the pouch dissolves and releases the treatment composition.

The substrate treatment composition can be a solid or liquid. Some pouches have multiple compartments and liquids in each of the compartments. Some pouches have multiple compartments with one compartment containing a solid and another compartment containing a liquid. Individual compartments of multi-compartment pouches can have different dissolution rates, thereby providing for delivery of the substrate treatment compositions within individual compartments at different times during the cycle of the wash.

Water soluble pouches are commonly produced by thermoforming a water soluble film. A water soluble film is positioned on a thermoforming mold, the film is thermoformed to conform with recesses in the mold, a substrate treatment composition is placed in the open pockets of the thermoformed water soluble film, and another water soluble film is joined to the thermoformed water soluble film to close the pockets. In practice, a continuous web comprising a plurality of closed pockets is produced. The continuous web of closed pockets is cut to yield individual closed pockets. Cutting may occur while the web of closed pockets is carried on the thermoforming mold or after the web is removed from the thermoforming mold. At some step of the process of manufacturing water soluble pouches, the individual pouches must be separated from the thermoforming mold.

Water soluble films used to manufacture water soluble pouches containing a substrate treatment composition tend to be soft, flexible, elastic, and sometimes tacky to the touch. These characteristics can complicate separation of the water soluble pouch from the thermoforming mold. High speed manufacturing processes are dependent upon precise control of the movement of the articles produced. Water soluble pouches that do not easily, predictably, and controllably separate from the thermoforming mold can result in processing irregularities downstream of the location in the process at which the water soluble pouches are separated from the thermoforming mold. Such process irregularities can include damaged or torn water soluble pouches and misalignment of water soluble pouches with respect to knives used to separate individual water soluble pouches from one another. With these limitations in mind, there is a continuing unaddressed need for thermoforming molds and process for using thermoforming molds that provide for improved ability to separate water soluble pouches from the thermoforming mold.

SUMMARY OF THE INVENTION

An apparatus comprising: a thermoforming mold having a forming surface; a plurality of spaced apart recesses in said forming surface, wherein each said recess comprises a vacuum orifice and each vacuum orifice is in fluid communication with a vacuum source; a continuous land area surrounding said recesses, wherein portions of said land area between said recesses have an average roughness Ra from 2.2 μm to 10 μm.

A process for making water soluble unit dose pouches comprising the steps of: providing a thermoforming mold comprising: a forming surface; a plurality of spaced apart recesses in said forming surface, wherein each recess comprises a vacuum orifice and each vacuum orifice is in fluid communication with a vacuum source; and a continuous land area surrounding said recesses, wherein portions of said land area between said recesses have an average roughness Ra from 2.2 μm to 10 μm; positioning a first water soluble film in facing relationship with said land area, wherein said first water soluble film comprises: from 50% to 95% by weight of said first water soluble film polyvinylalcohol polymer; from 5% to 50% by weight of said first water soluble film nonaqueous plasticizer; from 1% to 15% by weight of said water soluble film water; and surfactant; wherein said first water soluble film has a thickness from 20 μm to 150 μm before said first water soluble film is positioned in facing relationship with said land area of said thermoforming mold; heating said first water soluble film; applying vacuum to said first water soluble film through said vacuum orifices to thermoform said first water soluble film to said recesses thereby forming a plurality of open pockets; placing a substrate treatment composition in said plurality of open pockets; positioning a second water soluble film above said first water soluble film; joining said second water soluble film and said first water soluble film thereby forming a web (270) comprising a plurality of closed pouches; cutting said web to separate said closed pouches from one another; and separating said closed pouches from said forming surface.

BRIEF DESCRIPTION OF THE DRAWINGS

FIG. 8 are representative images of Mold set A and Mold set B.

DETAILED DESCRIPTION OF THE INVENTION

As used herein, with respect characterizing land area, average roughness Ra is defined and measured according to ISO 21920-1:2021. As used herein, with respect to characterizing recesses, roughness Sa is defined and measured according to ISO 21920-1:2021.

Figure 1:
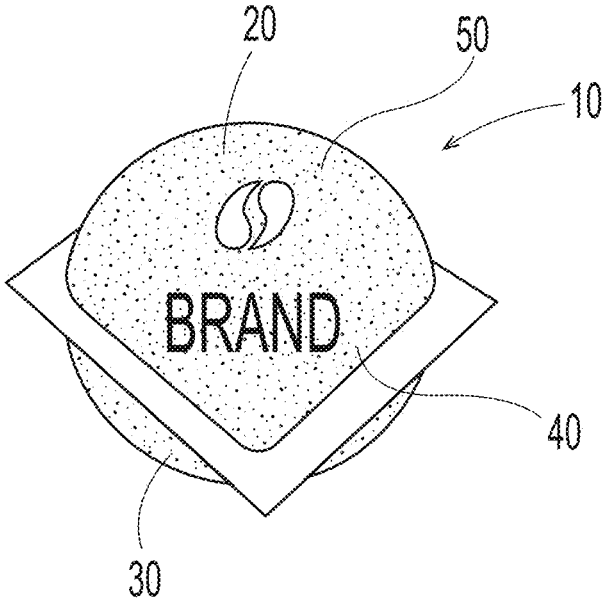
FIG. 1 is a water soluble pouch.

A water soluble unit dose pouch 10 is shown in FIG. 1. The pouch 10 can comprise a water soluble first sheet 20 and a water soluble second sheet 30. The water soluble second sheet 30 can be joined to the water soluble first sheet 20. Together, the two sheets can at least partially define a chamber 40 containing a substrate treatment composition 50.

Figure 2:
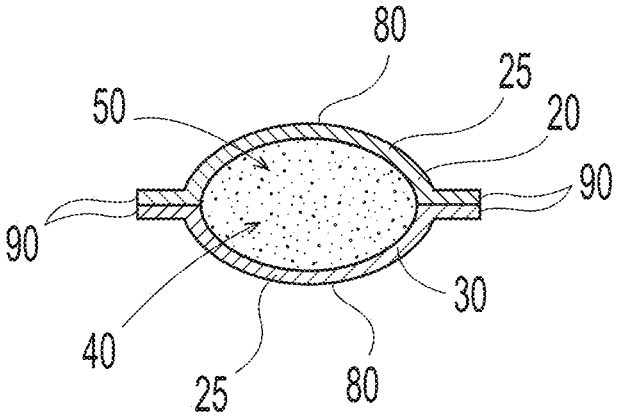
FIG. 2 is a cross section of a water soluble pouch.

Each of the first sheet 20 and second sheet 30 can have an interior surface 70 and an opposing exterior surface 80, as shown in FIG. 2. The interior surface 70 of the first sheet 20 and second sheet 30 can together form a chamber 40. The edges 90 of the first sheet 20 and second sheet can be joined to one another to form the chamber 40. Within the chamber 40, the substrate treatment composition 50 can be disposed. At least one of the first sheet 20 and second sheet 30 can be a thermoformed sheet 25. The interior surface 70 of the first sheet 20 and second sheet 30 can be oriented towards the chamber 40.

The plan view of the of the water soluble pouch 10 can be substantially rectangular, substantially square, substantially circular, substantially elliptical, substantially superelliptical, or any other desired shape that is practical to manufacture. The overall plan area of the water soluble pouch can be less than about 10000 $mm^2$, or even less than about 2500 $mm^2$. Sized and dimensioned as such, the water soluble pouch 10 can fit conveniently within the grasp of an adult human hand. Further, for water soluble pouches 10 intended for use in automatic dishwashing machines, such a size can conveniently fit in the detergent receptacle within the machine.

The edges 90 of the first sheet 20 and second sheet 30 can be bonded to one another. For example, the edges 90 of the first sheet 20 and second sheet 30 can be joined to one another by a thermal bond or a solvent weld or combination thereof. A thermal bond can be formed by applying one or more of heat and pressure to the two materials to be bonded to one another. A solvent weld can be formed by applying a solvent to one or both of the first sheet and second sheet and contacting the first sheet 20 and second sheet 30 in the location at which a bond is desired. For water soluble pouches, the solvent can be water and or steam.

The first sheet 20 and the second sheet 30 can be sufficiently translucent, or even transparent, such that the substrate treatment composition 50 is visible from the exterior of the pouch 10. That is, the consumer using the pouch 10 can see the substrate treatment composition 50 contained in the pouch 10.

The pouch 10 can have a plurality of chambers 40. For example a plurality of pouches 10 can be joined to one another to form a multi-compartment pouch. One or more pouches of the kind illustrated in FIG. 2 can be joined to one another. The pouch 10 can be of the type presently marketed as TIDE PODS, CASCADE ACTION PACS, CASCADE PLATINUM, CASCADE COMPLETE, ARIEL 3 IN 1 PODS, TIDE BOOST ORIGINAL DUO PACs, TIDE BOOST FEBREZE SPORT DUO PACS, TIDE BOOST FEE DUO PACS, TIDE BOOSE VIVID WHITE BRIGHT PACS, DASH, FAIRY (PLATINUM, ALL-IN ONE, YES (PLATINUM ALL-IN ONE, JAR (PLATINUM, ALL-IN ONE, DREFT (PLATINUM, ALL-IN ONE by The Procter & Gamble Company in various geographies globally. The pouch 10 can have 3 chambers 40. The first sheet and second sheet 30 can form a first chamber 40. Another first sheet 20 and second sheet 30 can form a second chamber 40 or one or more additional chambers 40. The two pouches 10 can be joined together. The chambers 40 can be superimposed upon one another. The chambers 40 can be a in a side by side relationship.

The substrate treatment composition 50 can be a liquid or solid. The substrate treatment composition 50 can be selected from the group consisting of laundry detergent, laundry additive, dishwashing detergent, hard surface cleaner, and dishwashing additive.

The pouch 10 can be sized and dimensioned to fit in an adult human hand. The pouch 10 can have a volume from about 5 mL to about 70 mL. The pouch 10 can have a volume from about 20 mL about 50 mL. The pouch 10 can have a volume from about 20 mL about 40 mL. The edges 90 can have a length of from about 10 mm to about 70 mm. The edges 90 can have a length of from about 20 mm to about 60 mm. The edges 90 can have a length of from about 25 mm to about 50 mm.

Figure 3:
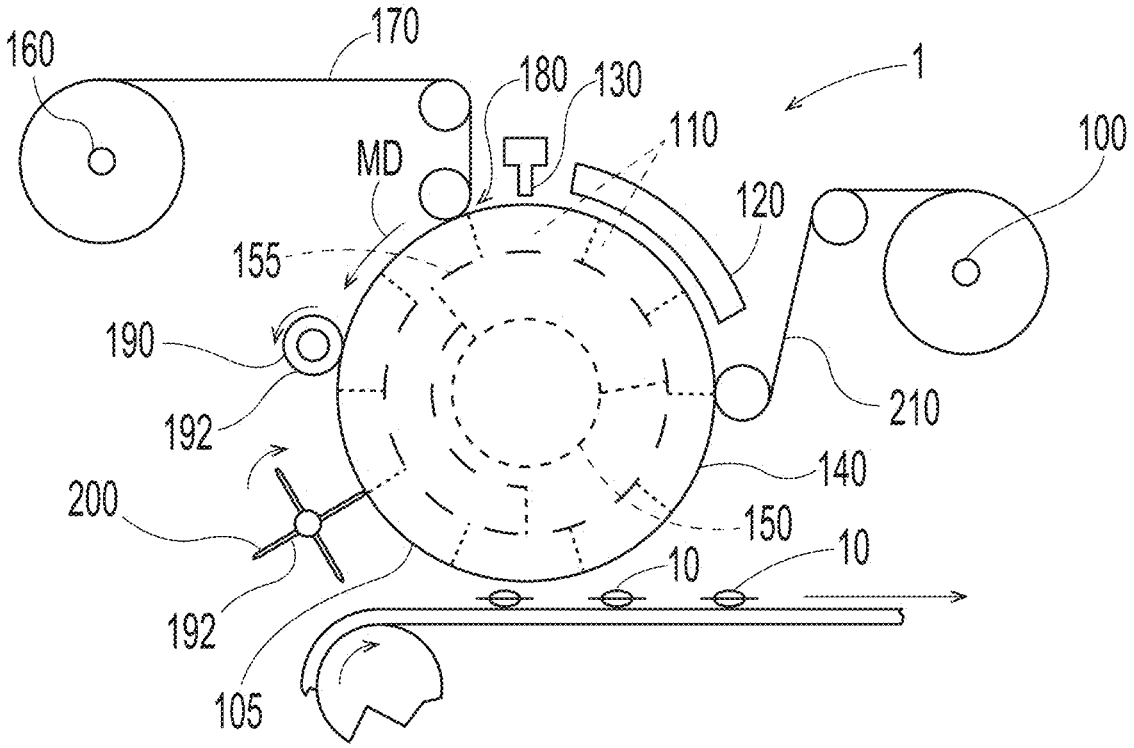
FIG. 3 is an apparatus for manufacturing a water soluble pouch.

An apparatus 1 for forming a water soluble pouch 10 is shown in FIG. 3. The apparatus 1 can comprise a first film unwind roll 100 and a thermoforming mold 110. The thermoforming mold 110 can be movable in the machine direction MD. The first unwind roll 100 can be upstream of the thermoforming molds 110. A heater 120 can be positioned downstream of the first film unwind roll 100. The heater 120 can be positioned between the first film unwind roll 100 and the merging location 180. The heater 120 can be positioned between the first film unwind roll 100 and the dosing device 130. The heater 120 can be a non-contact heater 120. The heater 120 can be an infrared heater. Optionally, the heater 120 can be a heated roller. A dosing device 130 can be positioned above the forming surface 140 of the thermoforming mold 110 at a location at which vacuum orifices in the thermoforming mold 110 are in fluid communication with a vacuum source 150. The thermoforming mold 110 can be slidably engaged with a vacuum manifold 155, the vacuum manifold being in fluid communication with each vacuum orifice. The vacuum manifold 155 can transmit vacuum from the vacuum source 250 to the recess or recesses of the thermoforming mold. A second film unwind roll 160 can be operably positioned to supply a continuous web of second water soluble film 170 above the forming surface 140 downstream of the dosing device 130 and at a merging location 180 at which the vacuum orifices are in fluid communication with the vacuum source 150.

The apparatus can further comprise a cutting system 192 downstream of the merging location 180. The cutting system 192 can comprise one or more longitudinal cutting knives 190 downstream of the merging location. The longitudinal cutting knives 190 can have a longitudinal cutting direction aligned with the machine direction MD. The longitudinal cutting knife 190 or knives 190 can be configured to cut the joined first water soluble film 210 and second water soluble film 170 in the machine direction between recesses adjacent to one another in the cross direction orthogonal to the machine direction MD. The longitudinal cutting knife 190 or knives 190 can be rotary cutting knives 190.

The cutting system 192 can comprise a plurality of transverse cutting knives 200 downstream of the merging location 180. The transverse cutting knives 200 can have a transverse cutting direction in the cross direction which is orthogonal to the machine direction MD. The transverse cutting knife 200 or transverse cutting knives 200 can be configured to cut the joined first water soluble film 210 and second water soluble film 170 in the cross direction between recesses adjacent to one another in the machine direction MD.

The cutting system 192 can comprise die cutters. Die cutters can provide for continuous cuts around the periphery of individual water soluble unit dose pouches 10. The die cutters can employ a stamping process that provide for cuts between individual water soluble unit dose pouches 10 by stamping a die to an anvil to cut around individual water soluble unit dose pouches 10 that form a web of water soluble pouches. The die cutters can be rotary die cutters that provide for die cuts between individual water soluble unit dose pouches 10 and employ a rotary process to make such cuts as a web of water soluble pouches 10 travels between the rotary die and anvil or anvil portion of the mold 110. Optionally, the cutting system 192 can be a laser cutting system 192. Optionally, the cutting system 192 can be a hot wire cutting system 192.

A continuous web of first water soluble film 210 can be positioned on the first film unwind roll 100. The first water soluble film 210 can extend downstream of the merging location 180 and can be positioned in facing relationship with the land area of the thermoforming mold 110 downstream of the first film unwind roll 100. Likewise, a continuous web of second water soluble film 170 can be positioned on the second film unwind roll 160. The second water soluble film 170 can extend downstream of the merging location 180 and be positioned above the first water soluble film 210 downstream of the merging location 180.

The thermoforming mold 110 can be mounted on a rotatable drum 105 or on a flat conveyance. A flat conveyance can be a continuous belt or a series of linear motor vehicles that carry the mold 10 in a straight line or horizontal line in the machine direction MD through the process of making water soluble unit dose pouches 10. The flat conveyance can be a series of individual molds 110 that can be positioned to abut one another to form the flat conveyance. The individual molds 110 can be joined to one another to provide for a continuous belt of molds 110. The forming surfaces 140 of the individual molds 110 abutting one another can form the flat conveyance. As the molds 110 traverse a curve, for example, when the molds 110 are recirculated upstream, the forming surfaces 140 of the molds 110 may become spaced apart from one another. Optionally, the forming surfaces 140 of the molds 110 may remain abutting to one another as the molds are recirculated upstream if the molds 110 are provided with structure that permits adjacent forming surfaces 140 to move hingedly relative to one another.

Figure 4:
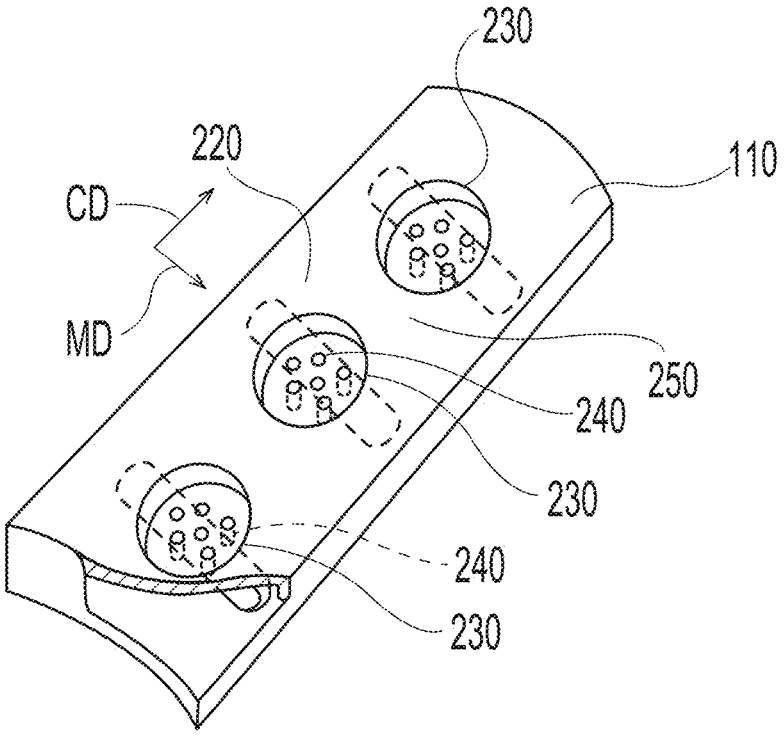
FIG. 4 is a thermoforming mold.

A thermoforming mold 110 is shown in FIG. 4. The thermoforming mold 110 can have a forming surface 220. The forming surface 220 is the surface to which the first water soluble film 210 is contacted. The forming surface 220 can comprise a plurality of spaced apart recesses 230. Each of the recesses 230 can comprise a vacuum orifice 240 or plurality of vacuum orifices 240. Each vacuum orifice 240 can be in fluid communication with a vacuum source 150.

A continuous land area 250 can surround the recesses 230. Portions of the land area 250 between the recesses 230 can have an average roughness Ra from 2.2 μm to 10 μm, optionally from 2.2 μm to 5 μm, optionally from 2.5 μm to 3.5 μm. Optionally, portions of each of the recesses 230 can have a roughness Sa from 2.2 μm to 10 μm, optionally from 2.2 μm to 5 μm, optionally from 2.5 μm to 3.5 μm. Optionally, from about 50% to about 100% by area of each recess 230 can have a roughness Sa from 2.2 μm to 10 μm, optionally from 2.2 μm to 5 μm, optionally from 2.5 μm to 3.5 μm. Area of the recess includes the vacuum orifices 240. Surprisingly, providing thermoforming mold 110 having a rough surface forming at least part or the entirety of the continuous land area 250 and or the recesses 230 can help improve the ability for the manufacturer to separate the water soluble pouch 10 or continuous web of water soluble pouches 10 from the thermoforming mold 110 after thermoforming. From 50% to 100%, optionally from 70% to 100%, optionally from 80% to 100%, optionally about 95%, optionally 100%, of the land area 25 between the recesses 230 can have an average roughness from 2.2 μm to 10 μm, optionally from 2.2 μm to 5 μm, optionally from 2.5 μm to 3.5 μm.

The forming surface 220, which includes the land area 250 and the recesses 230 can be fabricated of 5083 aluminum. The forming surface 220 can be treated by sand blasting to impart the desired average roughness Ra and roughness Sa. The forming surface 220 can be anodized.

The transition between the land area 250 and the recess can be chamfered or filleted. Chamfering or filleting the transition, or in other words the boundary between the land area 250 and the recess 230, can reduce stress concentrations in the water soluble film as it is thermoformed. The boundary between the land area 250 and recess 230 can be chamfered at an angle from about 10 degrees to about 80 degrees, optionally from about 20 degrees to about 70 degrees, optionally about degrees to about 50 degrees relative to the land area. The chamfering can be provided over a chamfer length measured in the direction of the chamfer of from about 0.05 mm to about 10 mm, optionally about 0.1 to about 1 mm, optionally about 0.2 mm. The filleting at the boundary between the land area 250 and recess 230 can be a convex curved surface. The filleting at the boundary between the land area 250 and recess 230 can have a radius from about 0.05 mm to about 5 mm, optionally about 0.1 mm to about 1 mm.

The depth of the recesses 230 relative to the land area 250 can be from about 1 mm to about 50 mm, optionally from about 5 mm to about 30 mm, optionally from about 10 mm to about 25 mm. The recesses 230 can have a curved shape. The bottom of the recesses 230 can be curved. Curved surfaces may tend to reduce stress concentrations in the thermoformed first water soluble film 210.

Water soluble pouches 10 containing a substrate treatment composition 50 are commonly manufactured by a thermoforming process. During thermoforming, the first water soluble film 210 is heated to improve the ability for the first water soluble film 210 to be formed into a shape in conformance with the thermoforming mold 110. When heated, water soluble film 210 of the type ordinarily used to construct water soluble pouches containing a substrate treatment composition 50 tends to become soft, flexible, elastic, and tacky. The tackiness can arise at least partly by the process of heating the first water soluble film 210 which can tend to result in the first water soluble film 210 expelling water.

Heat is typically applied to the water soluble film 210 immediately upstream of or at the location at which thermoforming occurs. Heat can be applied by passing the water soluble film 210 beneath one or more heat lamps, for example infrared heat lamps, rolling the water soluble film 210 over one or more heated rollers, or passing the water soluble film 210 over one or more heated plates.

Heat can be applied via a heat lamp, infrared heat lamp, heat plate, heat roller. Downstream of the location at which thermoforming occurs, heat is typically not added to the first water soluble film 210 or incidentally to the thermoforming mold 110. Once the water soluble pouches 10 are removed from the thermoforming mold 110, the thermoforming mold 110 travels a circuit to be back upstream of the location at which first water soluble film 210 is positioned in facing relationship with the land area 250 of the thermoforming mold 110. As the thermoforming mold 110 recirculates to again be upstream of the location at which first water soluble film 210 is placed on the land area 250 of the thermoforming mold 110, the thermoforming mold 110, and in particular the land area 250 and surfaces of the recesses 230, tends to cool relative to the temperature at which the thermoforming mold 110 and components thereof are when thermoforming occurs. As such, the temperature of the first water soluble film 210 when heated for thermoforming tends to be greater than the temperature of the land area 250 and surfaces of the recess 230 when the first water soluble film is placed onto the land area 250 of the thermoforming mold 110.

Water expelled by the first water soluble film 210 as a result of heating may be retained on the surface of the first water soluble film 210 presented to the land area 250 and recesses 230 of the thermoforming mold 110. Water on the surface of the first water soluble film 210 may partially solubilize the surface of the first water soluble film 210. When the first water soluble film 210 is positioned in contact with the land area 250, which may be cooler than the first water soluble film 210, the partially solubilized surface of the first water soluble film 210 may solidify, thereby adhering the first water soluble film 210 to the land area 250.

Furthermore, prior to the first water soluble film 210 being thermoformed, there is a gap between the first water soluble film 210 and the recesses 230. Water may evaporate from the surface of the first water soluble film 210 into the gap between the first water soluble film 210 and the surface of the recesses 230. Since the surfaces of the recesses 230 may be cooler than the first water soluble film 210, water vapor in the gap may condense onto the surface of the recesses 230. When the first water soluble film 210 is thermoformed into conformance with the recesses 230, the combination of a wet surface of the first water soluble film 210 that may be partially solubilized and condensation of water onto the surface of the recesses 230 can result in the first water soluble film 210 becoming adhered to the surface of the recesses 230.

Providing the forming surface 140 having a rough surface can help ease separation of the thermoformed pouches 10 from the thermoforming mold 110. A rough surface can also make separating the thermoformed pouches 10 from the thermoforming mold 110 more predictable and controllable. Without being bound by theory, it is thought that a rough surface tends to support the first water soluble film 210 at peaks of the rough surface and the first water soluble film 210 bridges from peak to peak. Thus for a rough surface, some portions of the surface of the first water soluble film 210 oriented towards the forming surface 140 between peaks of the rough surface may not be in contact with the forming surface 140. That can reduce the amount of force necessary for separating the pouch 10 from the forming surface 140 as compared to if the entirety of the surface of the first water soluble film 210 oriented towards the forming surface 140 was in contact with a smoother, or perfectly smooth, forming surface 140. Reducing the amount of force required to separate a pouch from the forming surface 140 can provide for more predictable separation of the pouch 10 from the forming surface 140 and improved control of the pouch 10 as it is separated from the forming surface 140. By improving control of separation of the pouch 10 from the forming surface 140, the manufacturing line speed may be increased compared to a manufacturing line employing thermoforming molds 110 having a smoother forming surface 140.

The forming surface 140 can have a forming surface area. The forming surface area is a scalar quantity in units of length squared. The forming surface area is computed based on the peripheral bounds of the forming surface. The forming surface 140 is the surface of the thermoforming mold 110 that contacts the first water soluble film 210. The forming surface area is computed such that variations in the surface topography of the forming surface 140 and the three dimensional shape of the recesses 230 are not accounted for. As such, the forming surface area is computed in the plane or curved plane defined by the continuous land area 250. For example, a rectangular forming surface having a length and a width has a forming surface area that is the product of the length and width, notwithstanding that the forming surface may not be perfectly smooth and includes recesses 230. Similarly, the continuous land area 250 can have a continuous land area surface area. The continuous land area surface area is computed based on the bounds, peripheral and internal, of the continuous land area 250. The continuous land area surface area does not include the recesses 230. The continuous land area surface area is computed such that variations in the surface topography of the continuous land area 150 are not accounted for. The continuous land area surface area can be less than about 40%, optionally less than about 30%, optionally less than about 25%, optionally from about 20% to about 35%, optionally from about 25% to about 30% of the forming surface area.

The recesses 230 can be sized and dimensioned to provide for open pockets that can accommodate a desired volume of substrate treatment composition. The recesses can have an individual volume from about 1 mL to about 50 mL. Recesses 230 can be spaced apart from one another by from about 5 mm to about 40 mm, optionally about 5 mm to about 25 mm. The recesses 130 can have a center to center spacing in the machine direction MD and cross direction from about 30 mm to about 80 mm, optionally from about 40 mm to about 60 mm.

Figure 6:
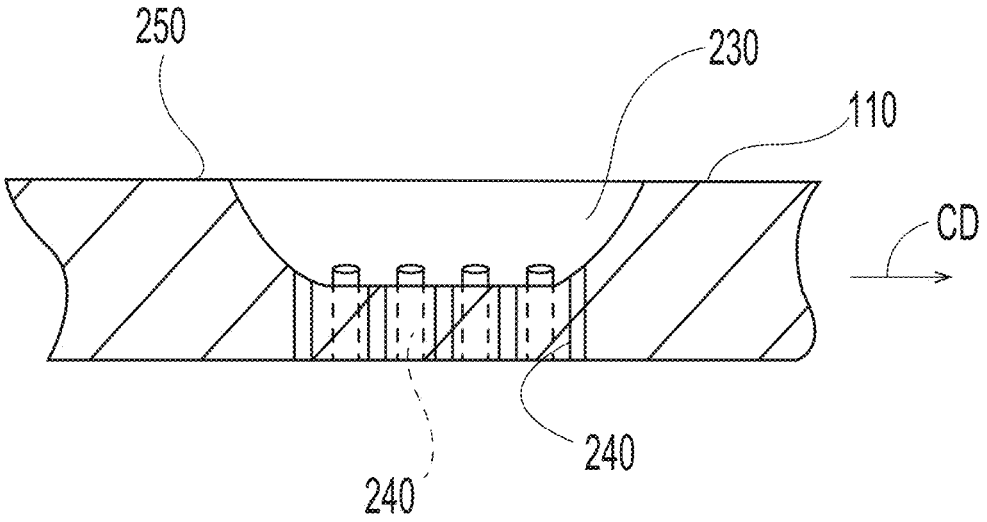
FIG. 6 is a thermoforming mold.

The recess 230 can be provided as shown in FIG. 6.

Figure 5:
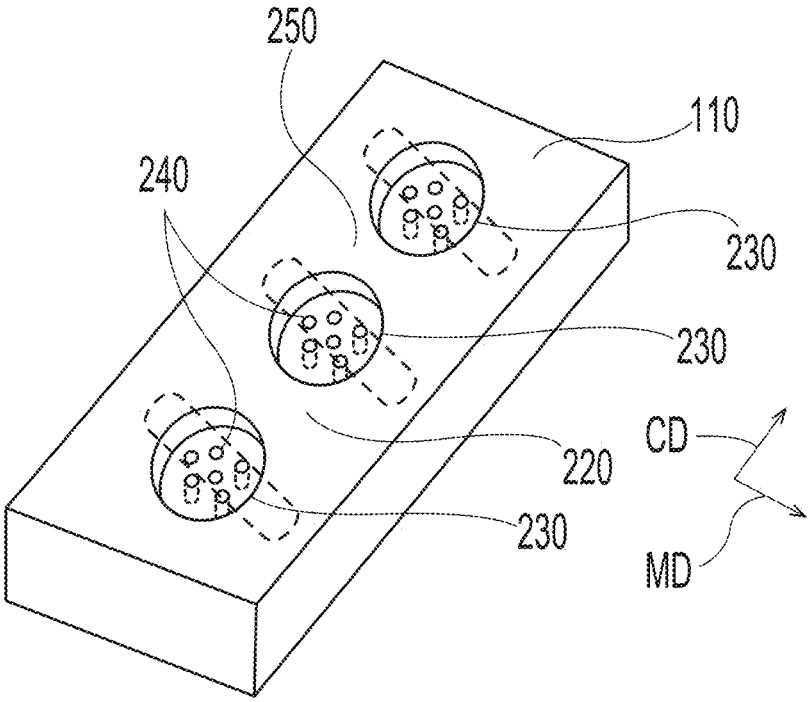
FIG. 5 is a thermoforming mold. ?
Figure 7:
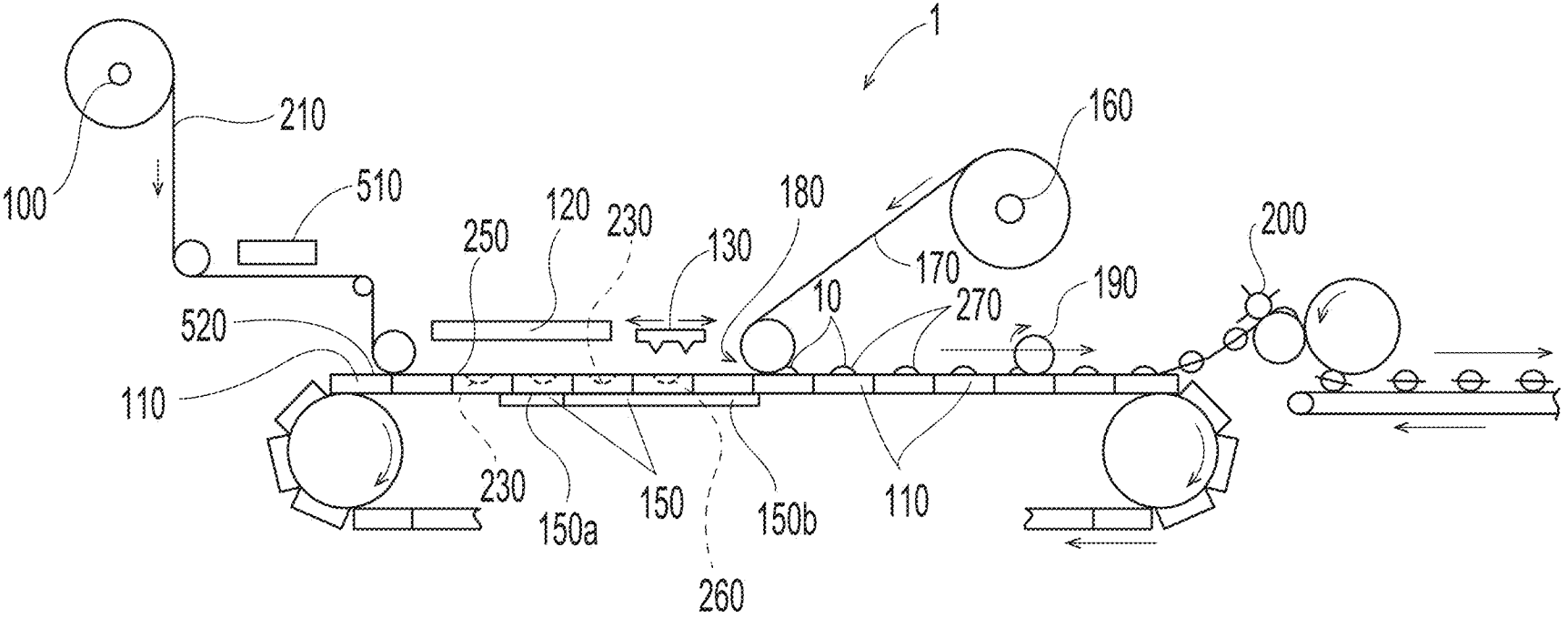
FIG. 7 is an apparatus for manufacturing a water soluble pouch.

The thermoforming molds 110 can be curved so as to be able to fit onto a drum 155 and operate in a rotary process, as illustrated in FIG. 3. Optionally, the thermoforming molds 110 can be flat, as shown in FIG. 5, so as to be usable in a process that operates along a flat conveyance 520. An apparatus 1 for forming a water soluble pouch 10 is shown in FIG. 7. The apparatus 1 can comprise a first film unwind roll 100, optionally a printing unit 510, a flat conveyance 520, a plurality of thermoforming molds 110 movably mounted on the flat conveyance 520, a heater 120, a dosing device 130, and a second film unwind roll 160. Upstream of the dosing device 130, the apparatus 1 can comprise a vacuum source 150. The vacuum source 150 can provide for two stages of vacuum application via a first vacuum source 150*a* and a second vacuum source 150*b*, the second vacuum source 150*b* being between the first vacuum source 150*a* and the dosing device 130. The first water soluble film 210 can be fed through the optional printing unit 510 prior to being placed on the flat conveyance 520. The first water soluble film 210 can then be fed onto the flat conveyance 520. The flat conveyance 520 can convey the thermoforming molds 110 in the machine direction MD. The dosing device 130 can be movable in the machine direction MD and in a direction upstream of the machine direction MD, for example a reciprocating dosing device 130.

The flat conveyance 520 can convey the thermoforming molds 110 and thereby first water soluble film 210 at a rate of from about 5 m/min to about 20 m/min, inclusive of any ranges of or single values of integers there between.

The flat conveyance 520 can carry a plurality of thermoforming molds 110. The films discussed herein can be held on the thermoforming molds 110 discussed herein by a web-holding vacuum system in the continuous land areas 250 of the thermoforming molds 110. The thermoforming molds 110 can be fabricated from aluminum or aluminum alloy. Each thermoforming mold 110 can have one or more spaced apart recesses 230. There can be one or more thermoforming molds in the cross machine direction. The flat conveyance 520 can convey the thermoforming molds 110 in the machine direction MD during formation and filling of the pouches 10.

As the first water soluble film 210 is conveyed in the machine direction MD, the first water soluble film 210 can pass beneath a heater 120. The heater 120 can be an infrared lamp. The heater 120 can be an infrared lamp having a temperature of from about 300° C. to about 500° C. As the first water soluble film 210 passes beneath the heater 120, the first water soluble film 210 can be heated to the desired temperature. The distance between the heater 120 and the first water soluble film 210 can be adjustable so that the temperature of the first water soluble film 210 can be controlled. Similarly, the temperature of the heater 120 can be adjustable so that the temperature of the first water soluble film 210 can be controlled. Multiple heaters 120 can be provided in series. The multiple heaters 120 can have the same temperature as one another or be set at different temperatures to vary the rate at which the first water soluble film 210 is heated.

As the first water soluble film 210 is heated to the desired temperature, the thermoforming mold 110 can be conveyed over the vacuum source 150. The vacuum source 150 can be used to apply a first negative gage pressure to the vacuum orifice 240 or vacuum orifices 240 of the recesses 230. When the first negative gage pressure is applied to the vacuum orifice 240 or vacuum orifices 240 the first water soluble film 210 can have a temperature from about 50° C. to about 90° C. over the recess 230. When the first water soluble film 210 is heated, it is possible that the temperature of the first water soluble film 210 is non-uniform in the machine direction MD and the cross direction. This can occur because part of the first water soluble film 210 is resting on the land area 250 of the thermoforming mold 110 and part of the first water soluble film 210 is overlying a recess 230. The difference in boundary conditions for the first water soluble film 210 in the direction of the thickness of the first water soluble film 210 can result in non-uniform heating of the first water soluble film 210. For instance, the portion of the first water soluble film 210 overlying the center of a recess 230 may be at a temperature of 107° C. and the portion of the first water soluble film 210 out on the land area 250 may have a temperature of about 25° C. The portion of the first water soluble film 210 overlying the center of a recess 230 may be at a temperature of 103° C. and the portion of the first water soluble film 210 out on the continuous land area 250 may have a temperature of about 26° C. The portion of the first water soluble film 210 overlying the center of a recess 230 may be at a temperature of 108° C. and the portion of the first water soluble film 210 out on the land area 250 may have a temperature of about 24° C. A higher temperature of the portion of the first water soluble film 210 overlying the center of a recess 230 can promote improved thermoforming resulting in fewer and or less structurally significant microscopic cracks. Further, higher temperatures during thermoforming can promote plastic deformation which can result in less internal pressure of the finished pouch 10 as compared to if the first water soluble film 210 is elastically deformed. If the temperature is too high, the first water soluble film 210 may become so pliable that the web may be drawn into the vacuum orifice 240 or vacuum orifices 240 in the recess 230, which can be detrimental to the structural integrity of the finished pouch 10.

Each of the vacuum orifices 240 can have an area from about 0.1 $mm^2$ to about 5 $mm^2$, optionally from about 0.2 $mm^2$ to about 4 $mm^2$. The vacuum orifices 240 can be circular. There can be from about 2 to about 50, optionally from about 5 to about 40, optionally from about 10 to about 30, vacuum orifices 240 in each recess 230. The vacuum orifices 240 can be sized such that at the temperature of thermoforming, the first water soluble film 210 is not drawn into the vacuum orifices 240 to a degree such that the structural integrity of the finished pouch 10 is compromised.

Each recess 230 in the thermoforming mold 110 can have a volume from about 1 mL to about 300 mL, optionally from about 1 mL to about 50 mL, optionally from about 1 mL to about 30 mL, optionally from about 1 mL to about 20 mL, optionally from about 14 mL to about 18 mL.

The first water soluble film 210 can be thermoformed in two stages. A first negative gage pressure can be applied to provide for initial thermoforming of the first water soluble film 210. A second negative gage pressure can be subsequently applied to complete thermoforming to conform the first water soluble film 210 to the recess 230. The first negative gage pressure can be from about mbar to about 90 mbar below atmospheric pressure. The first water soluble film 210 can be subjected to the first negative gage pressure for from about 1 s to about 10 s. The first water soluble film 210 can be subjected to the first negative pressure for from about 1 s to about 5 s. The first water soluble film 210 can be subjected to the first negative pressure for from about 1 s to about 3 s. The first negative gage pressure can be from about 10 mbar to about 50 mbar below atmospheric pressure. The first negative gage pressure can be from about 20 mbar to about 35 mbar below atmospheric pressure. The first water soluble film 210 can have a temperature from about 50° C. to about 90° C. over the recess 230 when vacuum is first applied to the first water soluble film 210. The lower the first negative gage pressure the faster the first water soluble film 210 will be deformed. Slower deformation can reduce the amount of micro-cracking in the deformed first water soluble film 210. For a lower temperature of deformation, the first negative gage pressure may be greater, i.e. less vacuum, so that deformation of the first water soluble film 210 is slow, which can reduce micro-cracking in the first water soluble film 210.

As the first water soluble film 210 is conveyed further in the machine direction MD, a second negative gage pressure can be applied to vacuum orifice 240 or vacuum orifices 240 of the recess 230. The second negative gage pressure can be applied with a second vacuum source **150*b*. The second negative gage pressure can be applied when the first water soluble film 210 above the recess 230** is at a temperature that is greater than the temperature at which vacuum is first applied.

For clarity, gage pressure is zero referenced at atmospheric pressure. So if the first negative gage pressure is 50 mbar below atmospheric pressure and the second negative gage pressure is 100 mbar below atmospheric pressure, it can be said that the second negative gage pressure is less than the first negative gage pressure. And, it can be said a gage pressure of 50 mbar below atmospheric pressure is a negative gage pressure since it is pressure below atmospheric pressure. Since a negative gage pressure of 50 mbar below atmospheric pressure is below atmospheric pressure, it is a vacuum. So, in the circumstances in which the second negative gage pressure is less than or equal to the first negative gage pressure, it can be thought of as the first negative gage pressure being a first level of vacuum and the second negative gage pressure being a second level of vacuum, and the second level of vacuum is more forceful than the first level of vacuum.

The temperature of the first water soluble film 210 above the recess 230 when a second negative gate pressure is applied can be from about 80° C. to about 150° C., optionally from about 100° C. to about 140° C. The second negative gage pressure can be from about 100 mbar to about 300 mbar, optionally from about 150 mbar to about 260 mbar below atmospheric pressure. The second negative gage pressure can be from about 180 mbar to about 260 mbar below atmospheric pressure. The second negative gage pressure can be from about 180 mbar to about 230 mbar below atmospheric pressure. The second negative gage pressure can be from about 210 mbar to about 230 mbar below atmospheric pressure. That is, the second negative gage pressure pulls harder on the first water soluble film 210 than the first negative gage pressure.

As the thermoforming mold 110 is conveyed downstream in the machine direction MD, the thermoforming mold 110 can be brought into position such that the second vacuum source 150*b* can apply a second negative gage pressure to the vacuum orifice 240 or vacuum orifices 240 of the thermoforming mold 110.

Formation of the pocket 260 in the first water soluble film 210 can be a multi-stage process. In the first stage of the process, the thermoforming mold 110 is positioned to be operatively engaged with the first vacuum source 150*a* to apply a first negative gage pressure to the vacuum orifice 240 or vacuum orifices 240 in the recess 230 to draw the first water soluble film 210 partially into the recess 230. In the second stage of the process, the thermoforming mold 110 is positioned to be operatively engaged with the second vacuum source 150*b* to apply a second negative gage pressure to the vacuum orifice 240 or vacuum orifices 240 in the recess 230 to draw the first water soluble film 210 further into the recess 230. The temperature of the first water soluble film 210 above the recess 230 can be greater than or equal to when the second vacuum source 150*b* is applied than when the first vacuum source 150*a* is applied.

After the vacuum has been applied to the first water soluble film 210 through the vacuum orifice 240 or vacuum orifices 240 to conform the first water soluble film 210 to the recesses 230 to form a plurality of open pockets 260, a substrate treatment composition 50 can be placed into the plurality of open pockets 260 via the dosing device 130. The second water soluble film 170 can then be brought into facing relationship with the thermoformed first water soluble film 210 and sealed to the first water soluble film 210 to form a pouch 10. The second water soluble film 170 can be at a temperature of from about ambient temperature to about 120° C. The second water soluble film 170 can be at a temperature of from about 10° C. to about 120° C. The second water soluble film 170 can be at a temperature of from about 20° C. to about 120° C.

Any suitable process of joining the first water soluble film 210 and the second water soluble film 170 may be used. The sealing may occur in the continuous land areas 250 between individual recesses 230 of the thermoforming mold 110. Non-limiting examples of such means include heat sealing, solvent welding, solvent or wet sealing, and combinations thereof. Heat and or solvent can be applied to the entire surface of the film or films or only the area which is to form the seal can be treated with heat or solvent. The heat or solvent can be applied by any process, typically on the closing material, and optionally only on the areas which are to form the seal. If solvent or wet sealing or welding is used, heat can also be applied. Wet or solvent sealing/welding processes include selectively applying solvent onto the area between the molds, or on the closing material, by for example, spraying or printing this onto these areas or applying water or other solvent by way of felt rollers that rotate through a bath of water or solvent, and then applying pressure onto these areas, to form the seal. Sealing rolls and belts as described above that optionally also provide heat can be used, for example.

A cutting operation can be integral with or located downstream of the apparatus shown in FIGS. 3 and 7 to separate the pouches 10 into individual pouches 10. The formed pouches 10 may then be cut by a cutting device. Cutting can be accomplished using any known process. A rotary knife 190 can be used to cut in the machine direction. A variable speed rotary transverse cutting knife 200 can be used to cut in the cross direction CD. The cutting can be done in continuous manner, optionally with constant speed and in a horizontal position. The cutting device can be a laser. The cutting device can, for example, be a sharp item or a hot item, whereby in the latter case, the hot item 'burns' through the sheet/sealing area. The cutting device or devices can be a rotary die cutter or flexible knife to make cuts in the cross direction and a cutting wheel to make cuts in the machine direction MD. Cuts in the machine direction MD, and optionally cross direction CD, can be made while the continuous web of water soluble pouches 10 is carried on the molds 110. Optionally, cuts in the machine direction MD can be made after lifting the continuous web or strips of water soluble pouches 10 off of the molds 10 and transferring the continuous web or strips of water soluble pouches 10 to an anvil upon which the pouches 10 are separated from one another in the cross direction CD.

From the viewpoint of an individual water soluble unit dose pouch 10, the process for making the water soluble unit dose pouch 10 is a multi-step process. A thermoforming mold 110 is provided. The thermoforming mold 110 can comprise a forming surface 140, a plurality of spaced apart recesses 230 in the forming surface 140, a vacuum source 150, and a continuous land area 250 surrounding the recesses 230. Each recess 230 can comprise a vacuum orifice 240 or vacuum orifices 240, each vacuum orifice 240 being in fluid communication with the vacuum source 150. Portions of the continuous land area 250 between the recesses 230 can have an average roughness from 2.2 μm to 10 μm. The first water soluble film 210 can be positioned in facing relationship with the continuous land area 250. The first water soluble film 210 can be heated. Vacuum can be applied to the first water soluble film 210 through the vacuum orifices 240 to thermoform the first water soluble film 210 to the recesses 230 thereby forming a plurality of open pockets 260. The substrate treatment composition 50 can be placed in the plurality of open pockets 260. A second water soluble film 170 can be positioned above the first water soluble film 210. The second water soluble film 170 and the first water soluble film 210 can be joined to one another to form a web 270 comprising a plurality of closed pouches 10. The web 270 can be cut to separate the closed pouches from one another. The closed pouches 10 can be separated from the forming surface 140, before or after the web 270 of closed pouches 10 is cut to separate closed pouches 10 from one another.

The first water soluble film 210 can have a temperature above the recess 230 from about 80° C. to about 150° C. upon thermoforming the first water soluble film 210. Without being bound by theory, it is thought that the amount of time that it takes to heat the first water soluble film 210 to such temperature from being at ambient temperature may permit an appreciable amount of water to be expelled by the first water soluble film 210 and such water may tend to condense onto the surface of the recess 230 and or partially solubilize the surface of the first water soluble film 210 facing the recess 230. Optionally, heat can be applied to the first water soluble film 210 for more than one second to heat the first water soluble film 210 from an ambient temperature to a temperature above the recess 230 that is from 80° C. to 150° C. before initiating thermoforming of the first water soluble film 210. Ambient temperature can be 20° C. plus or minus 5° C. (i.e. from 15° C. to 25° C.). The first water soluble film 210 can have a residence time while in facing relationship with the land area 250 of the thermoforming mold 110 at a temperature from 80° C. to 150° C. above the recess 230 before vacuum is first applied to the first water soluble film 210 that is greater than 1 second.

The apparatus 1 and process for making water soluble unit dose pouches 10 may be conducted in an environment under conditions of 23° C. +/−2° C. and 35%+/−5% relative humidity. The water soluble films employed herein may be conditioned to such environment. Water soluble films conditioned in such environment used herein can have a residual moisture content of at least 4%, optionally in a range of from 4% to 15%, optionally at least 5%, optionally from 5% to 10%, by weight of the water-soluble film as measured by Karl Fischer titration.

The first water soluble film 210 can have a temperature above the recess 230 from about 80° C. to about 150° C. after having been heated for more than one second before initiating thermoforming of the first water soluble film 210. The first water soluble film 210 can be in facing relationship with the land area 250 and the temperature of the water soluble film 210 above the recess 230 can be from about 80° C. to about 150° C. after having been heated for more than one second before initiating thermoforming of the first water soluble film 210. The first water soluble film 210 can have a residence time before thermoforming during which the first water soluble film 210 is in facing relationship with the land area 250 and the temperature of the water soluble film 210 above the recess 230 is heated from ambient temperature to 80° C. to 150° C. The residence time can be greater than one second. After the first water soluble film is positioned in facing relationship with the land area 250, the first water soluble film 210 can be heated above ambient temperature for more than one second to a temperature above the recess 230 from about 80° C. to about 150° C. before initiating thermoforming of the first water soluble film 210. After the first water soluble film 210 is positioned in facing relationship with the land area 250, the first water soluble film 210 can have a temperature above the recess 230 from about 80° C. to about 150° C. when thermoforming is initiated.

The first water soluble film 210 can be held at a tension in the machine direction MD from about 20 N/m of width to about 80 N/m of width, optionally from about 40 N/m of width to about 60 N/m of width. Tension in the machine direction MD can be controlled by provided by including a dancer engaged with the first water soluble film 210 between the first film unwind roll 100 and the location at which the first water soluble film 210 is positioned on the thermoforming molds 110.

Depending on the properties of the water soluble films forming the pouch 10, the first water soluble film 210 that is thermoformed to form the pocket 260 into which the substrate treatment composition 50 is placed may partially rebound after the first water soluble film 210 is joined to the second water soluble film 170. Depending on the properties of the first water soluble film 210 and the second water soluble film 170, the pouch 10 can be designed to have more or less curved surfaces.

Figure 8:
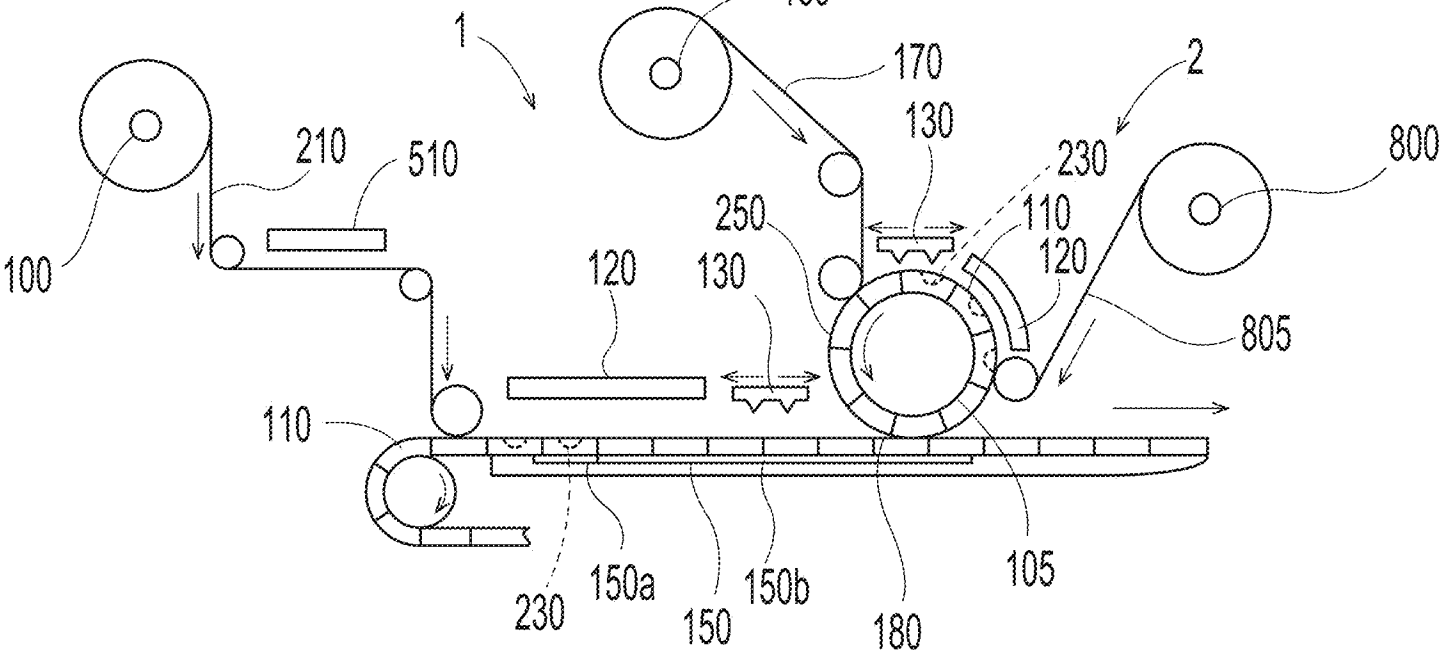
FIG. 8 is an apparatus for manufacturing a water soluble pouch.

If more than one pouch 10 are to be joined to one another, the apparatus 1 can be provided with a top pouch forming device 2, as shown in FIG. 8. In such an arrangement the bottom pouch 10 can be formed as described above with respect to forming pouches 10. The top pouch forming device 2 can comprise a third unwind roll 800. A third water soluble film 805 can be provided from the third unwind roll 800. The third water soluble film 805 can be heated with a heater 120 or heated roller. The heater 120 can heat the third water soluble film 805 to a temperature of from about 100° C. to about 135° C. The heater 120 can heat the third water soluble film 805 to a temperature of from about 100° C. to about 125° C. The higher the temperature of the third water soluble film 805, the greater the propensity for the deformation to be by thermoforming.

The third water soluble film 805 can be carried on a thermoforming mold 110. The thermoforming mold 110 that carries the third water soluble film 805 can be mounted on a rotatable drum 105, as shown in FIG. 8, or a flat conveyance 520 in substantially the same manner as thermoforming mold 110 that carries first water soluble film 210 shown in FIG. 7.

The thermoforming molds 110 for the top pouch forming device 2 are fundamentally structured in the same manner as the thermoforming molds 110 used to thermoform the first water soluble film 210. The recesses 230 in the top pouch forming device 2 can have a shape that differs from those used to shape the first water soluble film 210. The top pouch forming device 2 can comprise a vacuum source 150 operable on the thermoforming molds 110.

The third web 805 can be formed into an open pocket 260 by applying a pressure difference across the third water soluble film 805. Once the open pocket 260 is formed in the third water soluble film 805, a substrate treatment composition 50 can be placed in the open pocket 260. The open pocket 260 can be filled or partially filled with a substrate treatment composition 50. Filling or partial filling can be provided by a dosing device 130. Filling can occur when the open pocket 260 is proximal the apex of its travel path if a drum 105 is employed in thermoforming the first water soluble film 210 or third water soluble film 805. The dosing device 130 associated with the top pouch forming device 2 can travel with the thermoforming mold 110 and then reciprocate back upstream. For instance, the dosing device 130 that fills the open pocket 260 formed in the third water soluble film 805 can travel back and forth over a limited range of motion as shown in FIG. 8. After open pocket 260 in the third web 805 is filled, the second water soluble film 170 can then be sealed to the thermoformed third water soluble film 805 to form an enclosed pouch 10.

Any suitable process of sealing the second water soluble film 170 and the third water soluble film 805 may be used, as described previously for sealing the first water soluble film 210 and the second water soluble film 170.

The pouch 10 formed between the third water soluble film 805 and the second water soluble film 170 can then be joined with the first water soluble film 210 to form the pouch 10 between the second water soluble film 170 and the first water soluble film 210. The second water soluble film 170 and the first water soluble film 210 can be joined to one another as described previously. Such an arrangement can provide for a superposed pouch 10 in which two pouches overlie one another.

The substrate treatment composition 50 can be a liquid, but may be a solid or tablet. By the term 'liquid' it is meant to include liquid, paste, waxy or gel compositions. A liquid substrate treatment composition 50 may comprise a solid. Solids may include powder or agglomerates, such as microcapsules, beads, noodles or one or more pearlized balls or mixtures thereof. Such a solid element may provide a technical benefit, through the wash or as a pre-treat, delayed or sequential release component. Alternatively it may provide an aesthetic effect. The substrate treatment compositions 50 may comprise one or more of the ingredients discussed below.

The substrate treatment composition 50 of the present invention can comprise a surfactant. The total surfactant level may be in the range of from about 1% to about 80% by weight of the substrate treatment composition 50. The substrate treatment composition 50 can comprise linear alkylbenzene sulfonates and or alcoholethoxy sulfate and or C12-16 Pareth-9 and or fatty acid salts and or enzyme and or sodium carbonate and or sodium percarbonate and or methyl glycine diacetic acid, trisodium salt and or alcohol alkoxylate.

The substrate treatment composition 50 can be selected from the group consisting of liquid laundry detergent, a powdered laundry detergent, a liquid dishwashing detergent, a powder dishwashing detergent, a liquid bleaching agent, a powdered bleaching agent, a liquid fabric softener, a powdered fabric softener, a liquid laundry scent additive, a powder laundry scent additive, a liquid fabric care benefit agent, and a solid fabric care benefit agent. The substrate treatment composition 50 can be a fabric softener comprising a quaternary ammonium salt and or a dehydrogenated tallow dimethyl ammonium chloride and or a diethyl ester dimethyl ammonium chloride. A substrate treatment composition 50 can be formulated to treat a substrate selected from the group consisting of glassware, dishware, flooring, textiles, tires, automobile bodies, teeth, dentures, skin, fingernails, toenails, hair, appliance surfaces, appliance interiors, toilets, bathtubs, showers, mirrors, deck materials, windows, and the like.

The first water soluble film 210, second water soluble film 170, and optional third water soluble film 805 can be the water soluble film described as follows. The water soluble film of the present invention is soluble or dispersible in water. The water soluble film optionally has a thickness of from 20 to 150 micron, optionally 35 to 125 micron, optionally 50 to 110 micron, optionally about 76 micron.

The first water soluble film 210, second water soluble film 170, and optional third water soluble film 805 can comprise from about 50% to about 95% by weight of the respective water soluble film polyvinylalcohol polymer, from about 5% to about 50% by weight of the respective water soluble film nonaqueous plasticizer, from about 1% to about 15% by weight of the respective water soluble film water, and surfactant. The first water soluble film 210, second water soluble film 170, and optional third water soluble film 805 can have a thickness from about 20 μm to about 150 μm, optionally from about 35 μm to about 125 μm, optionally from about 50 μm to about 110 μm, optionally about 76 μm. The first water soluble film 210 can have a thickness from about 20 μm to about 150 μm, optionally from about 35 μm to about 125 μm, optionally from about 50 μm to about 110 μm, optionally about 76 μm, before being placed in facing relationship with the land area 250 of the thermoforming mold 110.

Optionally, the film has a water solubility of at least 50%, optionally at least 75% or even at least 95%, as measured by the method set out here after using a glass-filter with a maximum pore size of 20 microns: 5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersibility can be calculated.

The water soluble film material may be obtained by casting, blow-molding, extrusion or blown extrusion of the polymeric material, as known in the art.

The water soluble film can comprise polyvinylalcohol. The polyvinylalcohol may be present between 50% and 95%, optionally between 55% and 90%, optionally between 60% and 80% by weight of the water soluble film. The polyvinylalcohol optionally comprises polyvinylalcohol homopolymer, polyvinylalcohol copolymer, or a mixture thereof. Optionally, the water soluble film can comprise a blend of polyvinylalcohol homopolymers and/or anionic polyvinylalcohol copolymers, optionally wherein the polyvinylalcohol copolymers are selected from sulphonated and carboxylated anionic polyvinylalcohol copolymers especially carboxylated anionic polyvinylalcohol copolymers, optionally the water soluble film comprises a blend of a polyvinylalcohol homopolymer and a carboxylated anionic polyvinylalcohol copolymer, or a blend of polyvinylalcohol homopolymers. Alternatively, the polyvinylalcohol can comprise an anionic polyvinyl alcohol copolymer, optionally a carboxylated anionic polyvinylalcohol copolymer. When the polyvinylalcohol in the water soluble film is a blend of a polyvinylalcohol homopolymer and a carboxylated anionic polyvinylalcohol copolymer, the homopolymer and the anionic copolymer can be present in a relative weight ratio of 90/10 to 10/90, optionally 80/20 to 20/80, optionally 70/30 to 50/50. Without wishing to be bound by theory, the term "homopolymer" generally includes polymers having a single type of monomeric repeating unit (e.g., a polymeric chain comprising or consisting of a single monomeric repeating unit). For the particular case of polyvinylalcohol, the term "homopolymer" further includes copolymers having a distribution of vinyl alcohol monomer units and optionally vinyl acetate monomer units, depending on the degree of hydrolysis (e.g., a polymeric chain comprising or consisting of vinyl alcohol and vinyl acetate monomer units). In the case of 100% hydrolysis, a polyvinylalcohol homopolymer can include only vinyl alcohol units. Without wishing to be bound by theory, the term "copolymer" generally includes polymers having two or more types of monomeric repeating units (e.g., a polymeric chain comprising or consisting of two or more different monomeric repeating units, whether as random copolymers, block copolymers, etc.). For the particular case of polyvinylalcohol, the term "copolymer" (or "polyvinylalcohol copolymer") further includes copolymers having a distribution of vinyl alcohol monomer units and vinyl acetate monomer units, depending on the degree of hydrolysis, as well as at least one other type of monomeric repeating unit (e.g., a ter- (or higher) polymeric chain comprising or consisting of vinyl alcohol monomer units, vinyl acetate monomer units, and one or more other monomer units, for example anionic monomer units). In the case of 100% hydrolysis, a polyvinylalcohol copolymer can include a copolymer having vinyl alcohol units and one or more other monomer units, but no vinyl acetate units. Without wishing to be bound by theory, the term "anionic copolymer" includes copolymers having an anionic monomer unit comprising an anionic moiety. General classes of anionic monomer units which can be used for the anionic polyvinyl alcohol co-polymer include the vinyl polymerization units corresponding to monocarboxylic acid vinyl monomers, their esters and anhydrides, dicarboxylic monomers having a polymerizable double bond, their esters and anhydrides, vinyl sulfonic acid monomers, and alkali metal salts of any of the foregoing. Examples of suitable anionic monomer units include the vinyl polymerization units corresponding to vinyl anionic monomers including vinyl acetic acid, maleic acid, monoalkyl maleate, dialkyl maleate, monomethyl maleate, dimethyl maleate, maleic anyhydride, fumaric acid, monoalkyl fumarate, dialkyl fumarate, monomethyl fumarate, dimethyl fumarate, fumaric anyhydride, itaconic acid, monomethyl itaconate, dimethyl itaconate, itaconic anhydride, vinyl sulfonic acid, allyl sulfonic acid, ethylene sulfonic acid, 2-acrylamido-1-methylpropanesulfonic acid, 2-acrylamido-2-methylpropanesulfonic acid, 2-methylacrylamido-2-methylpropanesulfonic acid, 2-sufoethyl acrylate, alkali metal salts of the foregoing (e.g., sodium, potassium, or other alkali metal salts), esters of the foregoing (e.g., methyl, ethyl, or other C1-C4 or C6 alkyl esters), and combinations thereof (e.g., multiple types of anionic monomers or equivalent forms of the same anionic monomer). The anionic monomer may be one or more acrylamido methylpropanesulfonic acids (e.g., 2-acrylamido-1-methylpropanesulfonic acid, 2-acrylamido-2-methylpropanesulfonic acid, 2-methylacrylamido-2-methylpropanesulfonic acid), alkali metal salts thereof (e.g., sodium salts), and combinations thereof. Optionally, the anionic moiety of the first anionic monomer unit can be selected from a sulphonate, a carboxylate, or a mixture thereof, optionally a carboxylate, optionally an acrylate, a methacrylate, a maleate, or a mixture thereof. Optionally, the anionic monomer unit can be present in the anionic polyvinyl alcohol copolymer in an average amount in a range of between 1 mol. % and 10 mol. %, optionally between 2 mol. % and 5 mol. %. Optionally, the polyvinyl alcohol, and/or in case of polyvinylalcohol blends the individual polyvinylalcohol polymers, can have an average viscosity (μ1) in a range of between 4 mPa·s and 30 mPa·s, optionally between 10 mPa·s and 25 mPa·s, measured as a 4% polyvinyl alcohol copolymer solution in demineralized water at 20 degrees C. The viscosity of a polyvinyl alcohol polymer is determined by measuring a freshly made solution using a Brookfield LV type viscometer with UL adapter as described in British Standard EN ISO 15023-2:2006 Annex E Brookfield Test method. It is international practice to state the viscosity of 4% aqueous polyvinyl alcohol solutions at 20° C. It is well known in the art that the viscosity of an aqueous water soluble polymer solution (polyvinylalcohol or otherwise) is correlated with the weight-average molecular weight of the same polymer, and often the viscosity is used as a proxy for weight-average molecular weight. Thus, the weight-average molecular weight of the polyvinylalcohol can be in a range of 30,000 to 175,000, or 30,000 to 100,000, or 55,000 to 80,000. Optionally, the polyvinyl alcohol, and/or in case of polyvinylalcohol blends the individual polyvinylalcohol polymers, can have an average degree of hydrolysis in a range of between 75% and 99%, optionally between 80% and 95%, optionally between 85% and 95%. A suitable test method to measure the degree of hydrolysis is as according to standard method JIS K6726.

Optionally, the water soluble film can comprise a non-aqueous plasticizer. Optionally, the non-aqueous plasticizer can be selected from polyols, sugar alcohols, and mixtures thereof. Suitable polyols include polyols selected from the group consisting of glycerol, diglycerin, ethylene glycol, diethylene glycol, triethyleneglycol, tetraethylene glycol, polyethylene glycols up to 400 molecular weight, neopentyl glycol, 1,2-propylene glycol, 1,3-propanediol, dipropylene glycol, polypropylene glycol, 2-methyl-1,3-propanediol, trimethylolpropane and polyether polyols, or a mixture thereof. Suitable sugar alcohols include sugar alcohols selected from the group consisting of isomalt, maltitol, sorbitol, xylitol, erythritol, adonitol, dulcitol, pentaerythritol and mannitol, or a mixture thereof. More preferably the non-aqueous plasticizer is selected from glycerol, 1,2-propanediol, dipropylene glycol, 2-methyl-1,3-propanediol, trimethylolpropane, triethyleneglycol, polyethyleneglycol, sorbitol, or a mixture thereof, most preferably selected from glycerol, sorbitol, trimethylolpropane, dipropylene glycol, and mixtures thereof. One particularly suitable plasticizer system includes a blend of glycerol, sorbitol and trimethylol propane. Another particularly suitable plasticizer system includes a blend of glycerin, dipropylene glycol, and sorbitol. Optionally, the film comprises between 5% and 50%, preferably between 10% and 40%, optionally between 20% and 30% by weight of the film of the non-aqueous plasticizer.

Optionally, the water soluble film can comprise a surfactant. Optionally, the water soluble film can comprise a surfactant in an amount between 0.1% and 2.5%, optionally between 1% and 2% by weight of the water soluble film. Suitable surfactants can include the nonionic, cationic, anionic and zwitterionic classes. Suitable surfactants include, but are not limited to, polyoxyethylenated polyoxypropylene glycols, alcohol ethoxylates, alkylphenol ethoxylates, tertiary acetylenic glycols and alkanolamides (nonionics), polyoxyethylenated amines, quaternary ammonium salts and quaternized polyoxyethylenated amines (cationics), and amine oxides, N-alkylbetaines and sulfobetaines (zwitterionics). Other suitable surfactants include dioctyl sodium sulfosuccinate, lactylated fatty acid esters of glycerol and propylene glycol, lactylic esters of fatty acids, sodium alkyl sulfates, polysorbate 20, polysorbate 60, polysorbate 65, polysorbate 80, lecithin, acetylated fatty acid esters of glycerol and propylene glycol, and acetylated esters of fatty acids, and combinations thereof.

Optionally the water soluble film according to the invention can comprise lubricants/release agents. Suitable lubricants/release agents can include, but are not limited to, fatty acids and their salts, fatty alcohols, fatty esters, fatty amines, fatty amine acetates and fatty amides. Optional lubricants/release agents are fatty acids, fatty acid salts, and fatty amine acetates. The amount of lubricant/release agent in the water soluble film can be in a range of from 0.02% to 1.5%, optionally from 0.1% to 1% by weight of the water soluble film.

Optionally, the water soluble film comprises fillers, extenders, antiblocking agents, detackifying agents or a mixture thereof. Suitable fillers, extenders, antiblocking agents, detackifying agents or a mixture thereof include, but are not limited to, starches, modified starches, crosslinked polyvinylpyrrolidone, crosslinked cellulose, microcrystalline cellulose, silica, metallic oxides, calcium carbonate, talc and mica. Optional materials are starches, modified starches and silica. Optionally, the amount of filler, extender, antiblocking agent, detackifying agent or mixture thereof in the water soluble film is in a range of from 0.1% to 25%, optionally from 1% to 10%, optionally from 2% to 8%, optionally from 3% to 5% by weight of the water soluble film. In the absence of starch, one optional range for a suitable filler, extender, antiblocking agent, detackifying agent or mixture thereof is from 0.1% to 1%, preferably 4%, optionally 6%, optionally from 1% to 4%, optionally from 1% to 2.5%, by weight of the water soluble film.

Optionally, films exhibit good dissolution in cold water, meaning unheated distilled water. Optionally, such films exhibit good dissolution at temperatures of 24° C., optionally at 10° C. By good dissolution it is meant that the film exhibits water-solubility of at least 50%, optionally at least 75% or even at least 95%, as measured by the method set out here after using a glass-filter with a maximum pore size of 20 microns, described above.

Optional water soluble films include those films used in ARIEL 3-IN 1 PODS sold by The Procter & Gamble Company in the United Kingdom, and TIDE PODS in the United States as of March 2022.

The water soluble film may be opaque, transparent or translucent. The water soluble film may comprise a printed area. The area of print may be achieved using standard techniques, such as flexographic printing or inkjet printing. Optionally, the ink used in the printed area comprises between 0 ppm and 20 ppm, optionally between 0 ppm and 15 ppm, optionally between 0 ppm and ppm, optionally between 0 ppm and 5 ppm, optionally between 0 ppm and 1 ppm, optionally between 0 ppb and 100 ppb, optionally 0 ppb dioxane. Those skilled in the art will be aware of known methods and techniques to determine the dioxane level within the ink formulations.

The water soluble film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Optionally, the water soluble film or water soluble unit dose article or both are coated in a lubricating agent, preferably, wherein the lubricating agent is selected from talc, zinc oxide, silicas, siloxanes, zeolites, silicic acid, alumina, sodium sulphate, potassium sulphate, calcium carbonate, magnesium carbonate, sodium citrate, sodium tripolyphosphate, potassium citrate, potassium tripolyphosphate, calcium stearate, zinc stearate, magnesium stearate, starch, modified starches, clay, kaolin, gypsum, cyclodextrins or mixtures thereof.

Optionally, the water soluble film, and each individual component thereof, independently comprises between 0 ppm and 20 ppm, optionally between 0 ppm and 15 ppm, optionally between 0 ppm and 10 ppm, optionally between 0 ppm and 5 ppm, optionally between 0 ppm and 1 ppm, optionally between 0 ppb and 100 ppb, optionally 0 ppb dioxane. Those skilled in the art will be aware of known methods and techniques to determine the dioxane level within water soluble films and ingredients thereof.

Figure 9:
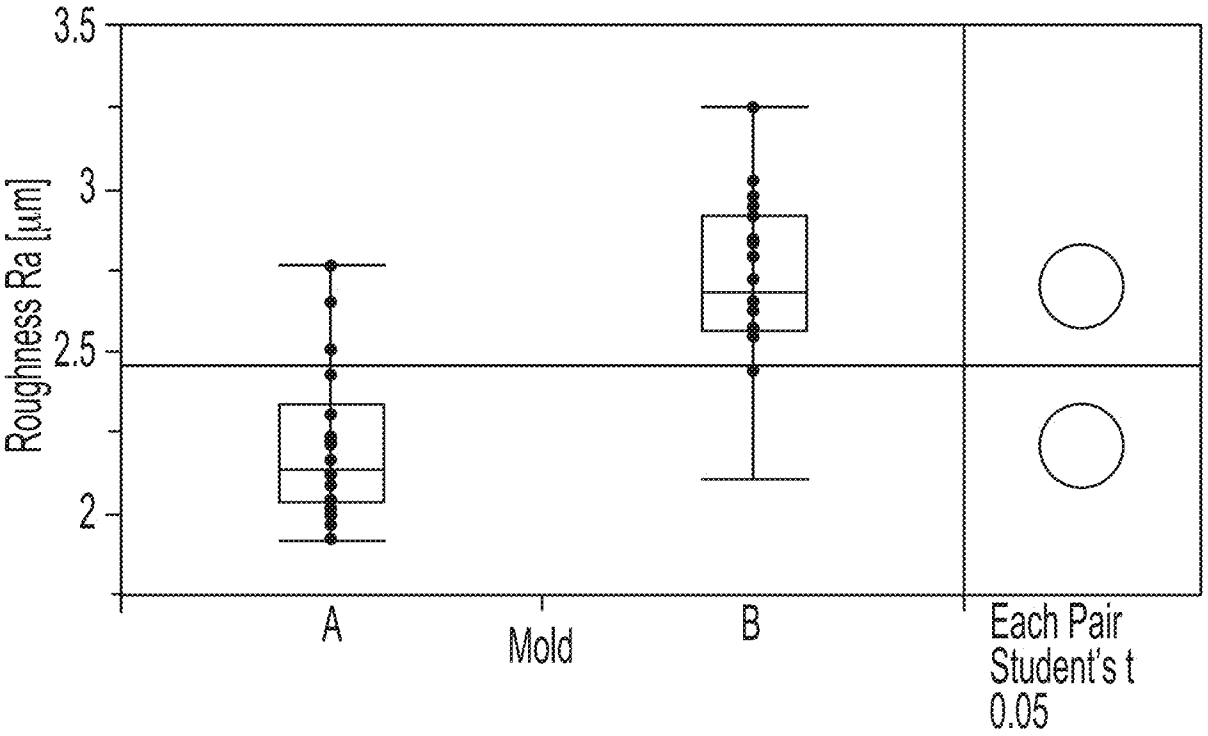
FIG. 9 is the measured distribution of average roughness Ra of Mold set A and Mold set B.
Figure 10:
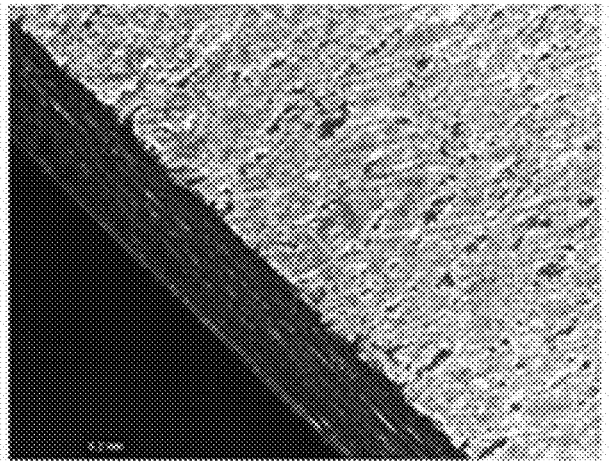
FIG. 10 are representative images of Mold set A and Mold set B.
Figure 10:
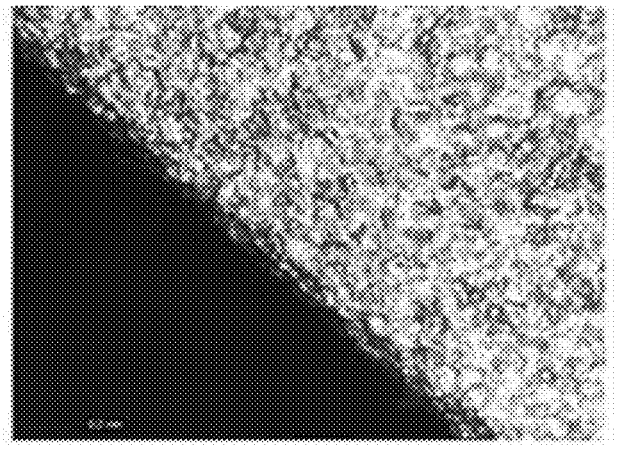

To evaluate the effect of average roughness Ra and roughness Sa of the forming surface 220 of the thermoforming mold 110, water soluble pouches 10 were made employing two different sets of molds 110 having the same shape. The molds 110 were fabricated of 5083 aluminum. The dimension of the recesses 230 were 41 mm by 43 mm in plan and 21 mm deep. Mold set A had an average roughness Ra of 2.1 μm. Mold set B had an average roughness Ra of 2.7 μm. Representative images of Mold set A and Mold set B are shown in FIG. 10. The measured distribution of average roughness Ra of Mold set A and Mold set B are shown in FIG. 9. The first water soluble film 210 and the second water soluble film 170 were same as those used in the outer films in ARIEL 3-in 1 PODS sold by The Procter & Gamble Company in the United Kingdom as of March 2022. A continuous web of pouches 10 was formed and then slit in the machine direction MD. The resulting continuous strips of pouches 10 were lifted from the molds by applying a pressure of about 300 mbar below atmospheric pressure to the second water soluble film 210. Pouches 10 formed on mold set A tended to stick to the molds 110 more than pouches formed on mold set B. The tendency of pouches 10 to stick to mold set A resulted in a loss of the vacuum applied to lift the pouches 10 from the molds 110 which tended to result in a loss of control of the position of the pouches 10. When mold set B was employed, the vacuum applied to lift the pouches was maintained and the control of the position of the pouches 10 was maintained as the pouches were lifted from the molds 110.

Combinations:

An Example follows:

A. An apparatus (1) comprising:
   - a thermoforming mold (110) having a forming surface (140);
   - a plurality of spaced apart recesses (230) in said forming surface, wherein each said recess comprises a vacuum orifice (240) and each vacuum orifice is in fluid communication with a vacuum source (150);
   - a continuous land area (250) surrounding said recesses, wherein portions of said land area between said recesses have an average roughness Ra from 2.2 μm to 10 μm.

B. The apparatus according to Paragraph A, wherein said thermoforming mold is slideably engaged with a vacuum manifold, wherein said vacuum manifold is in fluid communication with each vacuum orifice.

C. The apparatus according to Paragraph A or B, wherein said forming surface has a forming surface area and the said continuous land area has a continuous land area surface area, wherein said continuous land area surface area is from 20% to about 35% of said forming surface area.

D. The apparatus according to any of Paragraphs A to C, wherein said thermoforming mold is mounted on a rotatable drum (105) or flat conveyance (520).

E. The apparatus according to any of Paragraphs A to D, wherein said recesses have an individual volume from about 1 mL to about 50 mL.

F. The apparatus according to any of Paragraphs A to E, wherein portions of said recesses have a roughness Sa from 2.2 μm to 10 μm.

G. The apparatus according to any of Paragraphs A to F, wherein from 50% to 100% of said land area between said recesses has an average roughness Ra from 2.2 μm to 10 μm.

H. The apparatus according to any of Paragraphs A to G, wherein said thermoforming mold is movable in a machine direction (MD), wherein said apparatus further comprises:
   - a first film unwind roll (100) upstream of said thermoforming mold;
   - a heater (120) positioned downstream of said first film unwind roll;
   - a dosing device (130) positioned above said forming surface at a location at which said vacuum orifices are in fluid communication with said vacuum source;

a second film unwind roll operably positioned to supply a continuous web of second water soluble film (170) above said forming surface downstream of said dosing device and at a merging location (180) at which said vacuum orifices are in fluid communication with said vacuum source; and a cutting system 192 downstream of said merging location.

I. The apparatus according to Paragraph H, wherein a continuous web of first water soluble film (210) is positioned on said first film unwind roll and extends downstream of said merging location and is positioned in facing relationship with said land area downstream of said first film unwind roll, and wherein a continuous web of second water soluble film is positioned on said second film unwind roll and extends downstream of said merging location and is positioned above said first water soluble film downstream of said merging location.

J. A process for making water soluble unit dose pouches comprising the steps of:

providing said apparatus according to any of Paragraphs A to I;

positioning a first water soluble film in facing relationship with said land area, wherein said first water soluble film comprises:

from 50% to 95% by weight of said first water soluble film polyvinylalcohol polymer;

from 5% to 50% by weight of said first water soluble film nonaqueous plasticizer;

from 1% to 15% by weight of said first water soluble film water; and surfactant;

wherein said first water soluble film has a thickness from 20 μm to 150 μm before said first water soluble film is positioned in facing relationship with said land area of said thermoforming mold;

heating said first water soluble film;

applying vacuum to said first water soluble film through said vacuum orifices to thermoform said first water soluble film to said recesses thereby forming a plurality of open pockets;

placing a substrate treatment composition in said plurality of open pockets;

positioning a second water soluble film above said first water soluble film;

joining said second water soluble film and said first water soluble film thereby forming a web (270) comprising a plurality of closed pouches;

cutting said web to separate said closed pouches from one another; and separating said closed pouches from said forming surface.

K. The process according to Paragraph J, wherein said first water soluble film has a temperature above said recess from 80° C. to 150° C. upon thermoforming said first water soluble film.

L. The process according to Paragraph J or K, wherein heat is applied to said first water soluble film for more than one second to heat said first water soluble film from an ambient temperature to a temperature above said recess that is from 80° C. to 150° C. before initiating thermoforming of said first water soluble film.

M. The process according to any of Paragraphs J to L, wherein portions of said recesses have a roughness from 2.2 μm to 10 μm.

N. The process according to Paragraph M, wherein from about 50% to about 100% by area of each recess 230 can have a roughness Sa from 2.2 μm to 10 μm, optionally from 2.2 μm to 5 μm, optionally from 2.5 μm to 3.5 μm.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for making water soluble unit dose pouches comprising:

a thermoforming mold having a forming surface;

a plurality of spaced apart recesses in said forming surface, wherein each recess of the plurality of spaced apart recesses comprises a vacuum orifice and each vacuum orifice is in fluid communication with a vacuum source;

a continuous land area surrounding said plurality of spaced apart recesses, wherein portions of said land area between said plurality of spaced apart recesses have an average roughness Ra from 2.2 μm to 10 μm, wherein said forming surface has a forming surface area and said continuous land area has a continuous land area surface area, wherein said continuous land area surface area is from 20% to 35% of said forming surface area;

wherein the water soluble unit dose pouches comprise:

a first water soluble film;

wherein said first water soluble film comprises:

from 50% to 80% by weight of said first water soluble film of polyvinylalcohol polymer;

from 20% to 50% by weight of said first water soluble film of nonaqueous plasticizer;

from 1% to 15% by weight of said first water soluble film of water;

and surfactant;

wherein said first water soluble film has a thickness from 20 μm to 150 μm before said first water soluble film is positioned in facing relationship with said land area of said thermoforming mold;

wherein heat is applied to said first water soluble film upstream of the location at which thermoforming occurs.

2. The apparatus according to claim 1, wherein said thermoforming mold is slideably engaged with a vacuum manifold, wherein said vacuum manifold is in fluid communication with each vacuum orifice.

3. The apparatus according to claim 2, wherein said thermoforming mold is mounted on a rotatable drum or flat conveyance.

4. The apparatus according to claim 3, wherein said plurality of spaced apart recesses have an individual volume from 1 mL to 50 mL.

5. The apparatus according to claim 4, wherein portions of said plurality of spaced apart recesses have a roughness Sa from 2.2 μm to 10 μm.

6. The apparatus according to claim 5, wherein from 50% to 100% of said land area between said plurality of spaced apart recesses has an average roughness Ra from 2.2 μm to 10 μm.

7. The apparatus according to claim 1, wherein said thermoforming mold is mounted on a rotatable drum or flat conveyance.

8. The apparatus according to claim 1, wherein said plurality of spaced apart recesses have an individual volume from 1 mL to 50 mL.

9. The apparatus according to claim 1, wherein portions of said plurality of spaced apart recesses have a roughness Sa from 2.2 μm to 10 μm.

10. The apparatus according to claim 1, wherein from 50% to 100% of said land area between said plurality of spaced apart recesses has an average roughness Ra from 2.2 μm to 10 μm.

11. The apparatus according to claim 1, wherein said thermoforming mold is movable in a machine direction, wherein said apparatus further comprises:

a first film unwind roll positioned upstream of said thermoforming mold;

a heater positioned downstream of said first film unwind roll;

a dosing device positioned above said forming surface at a location at which said vacuum orifices are in fluid communication with said vacuum source;

a second film unwind roll operably positioned to supply a continuous web of second water soluble film above said forming surface downstream of said dosing device and at a merging location at which said vacuum orifices are in fluid communication with said vacuum source;

and a cutting system positioned downstream of said merging location.

12. The apparatus according to claim 11, wherein a continuous web of said first water soluble film is positioned on said first film unwind roll and extends downstream of said merging location and is positioned in facing relationship with said land area downstream of said first film unwind roll, and wherein a continuous web of second water soluble film is positioned on said second film unwind roll and extends downstream of said merging location and is positioned above said first water soluble film downstream of said merging location.

* * * * *